United States Patent [19]

Okumura et al.

[11] 4,417,595

[45] Nov. 29, 1983

[54] HAIRBRUSH

[75] Inventors: Takeo Okumura, Sakura; Miho Imai, Ichikawa, both of Japan

[73] Assignee: Kao Soap Co., Ltd., Tokyo, Japan

[21] Appl. No.: 262,356

[22] Filed: May 11, 1981

[30] Foreign Application Priority Data

May 16, 1980 [JP] Japan ..... 55-67300[U]
Apr. 14, 1981 [JP] Japan ..... 56-53573[U]

[51] Int. Cl.[3] ..... A45D 44/18
[52] U.S. Cl. ..... 132/85
[58] Field of Search ..... 132/85, 152, 121, 150

[56] References Cited

U.S. PATENT DOCUMENTS

| | | | |
|---|---|---|---|
| D. 137,635 | 4/1944 | Lotters | 132/85 UX |
| 1,672,469 | 6/1928 | Oshman et al. | 132/121 |
| 3,683,942 | 8/1972 | McKay | 132/112 |
| 3,931,826 | 1/1976 | Moon | 132/85 |
| 3,990,461 | 11/1976 | Katz | 132/85 |
| 4,030,158 | 6/1977 | Blair et al. . | |
| 4,161,050 | 7/1979 | Sasaki et al. | 132/85 |
| 4,196,489 | 4/1980 | Hahn | 132/85 X |
| 4,211,217 | 7/1980 | Gueret | 132/85 |
| 4,226,251 | 10/1980 | Wall | 132/85 |
| 4,285,087 | 8/1981 | Sapronetti | 132/85 |
| 4,307,739 | 12/1981 | Chern | 132/85 |
| 4,368,376 | 1/1983 | Andis | 132/150 |

FOREIGN PATENT DOCUMENTS 17492 of 1914 United Kingdom .

*Primary Examiner*—Gregory E. McNeill
*Attorney, Agent, or Firm*—Flynn, Thiel, Boutell & Tanis

[57] ABSTRACT

A hairbrush having a base which comprises a bristle-implanted portion on which bristles are implanted and a handle portion formed continuously onto said bristle-implanted portion, said bristles being dispersively and independently implanted radially in respect to said bristle-implanted portion within a region covered by a vertical angle of 210° to 270° in respect to the longitudinal central axis of said bristle-implanted portion on the peripheral surface of said bristle-implanted portion.

9 Claims, 12 Drawing Figures

HAIRBRUSH

The present invention relates to a hairbrush. More particularly, the present invention relates to a hairbrush having a base comprising an implanted portion having bristles implanted thereon and a handle portion formed contiguously to the implanted portion, wherein bristles are independently implanted radially in a peripheral zone of the implanted portion over a region defining an angle of from 210° to 270°.

As a blow-dry styling brush for setting a hair style while drying hair with a dryer, there have been marketed a brush having a base called a "handle" which comprises an implanted portion having radial bristles on the entire periphery thereof and a brush having bristles implanted only within a region covered by a vertical angle of one fourth of the periphery. The former brush is called a roll brush.

In the roll brush formed by using animal bristles, the number of bristles implanted on each hole is large, and when a hair style is set during the blow-drying treatment, combing is difficult and the property of holding hairs on the bristles is not good. Furthermore, the roll brush is defective in that sufficient hair curling of hairs is impossible. Moreover, excessive numbers of hairs become entangled with bristles and hairs are pulled, hurting the skin, and therefore the touch and feel of the roll brush are not good.

In a roll brush having molded bristles independently implanted instead of animal bristles, or groups including 2 to 4 filamentary plastic bristles implanted instead of animal bristles, excessive hair entanglement is observed and the touch and feel are not good. Accordingly, no substantial improvement is attained.

In a half-round brush, hairs can easily be combed and entanglement of hairs is reduced. However, the property of holding hairs on the bristles is not good and the curl-forming capacity is especially poor.

As is seen from the foregoing description, conventional hairbrushes for setting a hair style by blow finishing while drying hairs with a drier are not satisfactory and development of improved hairbrushes has been desired by users.

The present inventors conducted research with a view to providing a hairbrush for blow finishing in which both the curl-forming capacity and brushing operation adaptability are satisfactory, and found that when bristles are independently implanted on the periphery of an implanted portion of a base of a hairbrush radially over a region of an angle of from 210° to 270° at a rate of one bristle per hole, both the curl-forming capacity and brushing operation adaptability can remarkably be improved. The present device has now been completed based on this finding.

In accordance with the present device, there is provided a hairbrush having a base comprising an implanted portion having bristles implanted thereon and a handle portion formed contiguously to the implanted portion, wherein bristles are independently implanted radially in a peripheral zone of the implanted portion over a region defining an angle of from 210° to 270°.

BRIEF DESCRIPTION OF THE DRAWINGS

The drawings illustrate embodiments of the present device, in which.

Figure 1:
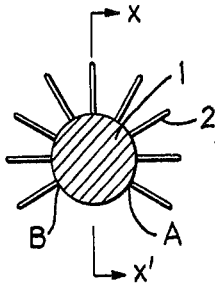
FIG. 1 is a cross sectional view of a first embodiment.

In the drawings, the numeral references identify the following elements:

1: implanted portion, 2: bristle, 3: handle portion, 4: support, 5: bristle end, 6: implanting hole, 7: pin, 13: core portion, 14: opening, 15: fastener, 16: wall, 17: recess, 18: stopper 19: flat portion, 20: projection , 21: cover, 22: bristle-implanted sheet, 23: flexible sheet, 25: raised edge of the flexible sheet, 26: raised indication.

An embodiment of the present device will now be described in detail with reference to the accompanying drawings.

FIG. 1 is a view showing the cross section of an implanted portion 1 of the hairbrush of the present invention. Bristles 2 are not implanted along the entire periphery of the implanted portion 1 of the base, but rather are implanted over a specific region defining an angle of 210° to 270° starting from the point A and ending at the point B.

Figure 2:
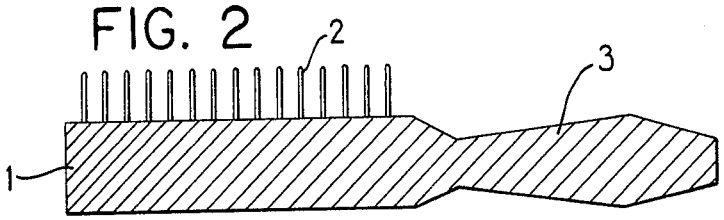
FIG. 2 is a view showing the longitudinal section taken along the line X—X' in FIG. 1, and FIGS. 3 and 4 are views showing two types of cross sections of implanted bristles.

FIG. 2 is a view showing the longitudinal section taken along the line X—X' in FIG. 1, from which it is seen that bristles 2 are not implanted at all in the non-implanted portion shown in FIG. 1.

Figure 3:
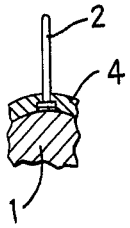
Figure 4:
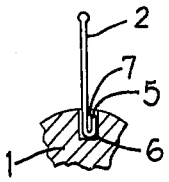

The term "implanting" is used in a broad sense in the present device. For example, a case wherein bristles 2 are merely implanted and a case wherein the implanted portion 1 is already provided with bristles 2 are included in the present device. Accordingly, as the implanting method, there may be adopted a method in which, as shown in FIG. 4, bristles 2 are implanted in implanting holes 6 formed in the implanted portion 1 with pins 7, and a method in which, as shown in FIG. 3, holes are formed on a support 4 composed of a flexible sheet or plastic plate, wherein bristles 2 are inserted into these holes and the support 4 is wound on a base to form an implanted portion 1. Furthermore, wires or yarns may be used instead of the pins 7. Moreover, there may be adopted a known implanting method in which the entire structure of the implanted portion 1 is integrally molded.

In order to enhance the effect of protecting hairs, it is preferred that the lower end 5 of each bristle 2 be not exposed on the surface of the implanted portion 1 as shown in FIG. 4.

In the present device, the shape of the implanted portion 1 is not particularly critical. It is, however, preferred that the shape of the cross section of the implanted portion 1 be circular. A handbrush having a base diameter of 10 to 25 mm is easily handled, and from the viewpoint of the handling easiness, it is preferred that the size or diameter of the bristles 2 be 0.5 to 2 mm and the exposed length of the bristles 2 be 10 to 25 mm.

The base and bristles may be formed of a plastic material or metal, and a wooden base may be used as the implanted portion 1.

The implantation density of bristles 2 is preferably 3 to 25 bristles per $cm^2$, especially 9 to 25, and from the viewpoint of the handling easiness, it is preferred that the length of the implanted portion be 60 to 100 mm.

As a preferable embodiment, a hair brush of the invention principally comprises a base and a flexible sheet having bristles 2 thereon, more particularly a hairbrush having a base which comprises a bristle-implanted portion 1 on which bristles are implanted and a handle portion 3 formed continuously onto said bristle-implanted portion 1, said bristles 2 being dispersively and independently implanted radially in respect to said bristle-implanted portion 1 within a region covered by a vertical angle of 210° to 270° with respect to the longitudinal central axis of said bristle-implanted portion 1 on the peripheral surface of said bristle-implanted portion 1.

Other embodiments (I), (II) and (III) mentioned below, fall within the scope of the invention.

In the embodiment (I), there is provided a hairbrush in which bristles 2 implanted near to the portion having no bristles 2 implanted therein are shorter than the bristles 2 implanted, close to the center on the implanted area, of said bristle-implanted portion 1.

Figure 5:
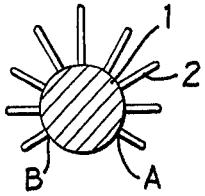
FIG. 5 shows an embodiment of the invention in which shorter bristles are used with longer bristles.
Figure 11:
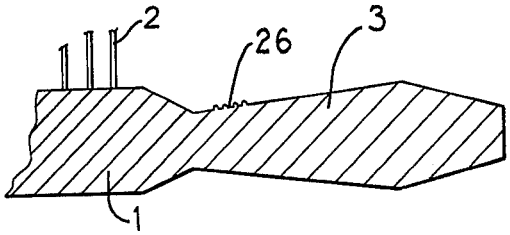
FIG. 11 is a longitudinal cross section of an embodiment of the invention in which the handle portion has a raised indication means.
Figure 12:
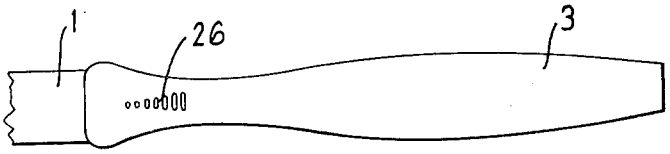
FIG. 12 is a plan view of a handle portion having a raised indication means.

In other words, the implanted bristles 2 vary in respect to their length in the above defined manner. This embodiment can provide advantages of high curling ability and easy operation. The bristles 2 have different lengths as seen in the sectional view of FIG. 5. The best mode in the difference of the bristle lengths is such that the closer to the top of the hairbrush the bristles 2 are, in view of the section as shown in FIG. 5, the longer they are.

In other words, the bristles located along the longitudinal center line of the hairbrush are longest and those located at the edges of the bristle-implanted area are shortest.

As a variation of the embodiment (I), it is acceptable that the bristles located around the middle area between the top and the edges have the same length, the top bristles are longer than the bristles in the middle area and the edge bristles are shorter than them.

Considering a sectional view of the hairbrush cut along a vertical plane at a right angle to the longitudinal axis of the hairbrush, it is preferable that the hairbrush has 5 to 20 lines of bristles up to 80% of which are the longest. The longest bristles are preferred to be 10 to 25 mm long and the shortest, 3 to 20 mm long. A length ratio of the longest to the shortest is preferred to range from 1:0.3 to 1:0.8. These preferable features can provide the high curling ability, easy operation and comfortable use.

In the second embodiment (II), the bristle-implanted portion may be a construction which comprises a base body integral a handle portion 3, that is, a tube-like core portion 13 formed continuously to said handle portion 3, a flexible sheet 23 having bristles 2 implanted therein and a protuberant stopper 18, where said core portion has a slit-like opening 14 in the longitudinal direction on one side thereof, and in the inside thereof has a fastener 15 having a recess 17 to receive said protuberant stopper. Said flexible sheet 23 is wound on the surface of said core portion 13, inserted at both ends 25 of the flexible sheet 23 into said opening 14 of the core portion 13. Said protuberant stopper 18 is connected with said fastener 15 through said opening 14 of the core portion 13 so as to press against both ends 25 of the flexible sheet 23 inserted therein and fix the flexible sheet 23 to the core portion 13.

The above-defined bristle-implanted portion will be illustrated below in reference to FIGS. 6 to 10.

As clarified in these drawings, the core portion 13 is shaped like a cylindrical tube and has an opening, like a slit, running on one side thereof in the longitudinal direction from a position near to the top to the end. The opening has to be wide enough to receive therein both ends of the flexible, bristle-implanted sheet 22. It further has a fastener 15 at a position opposite to the opening on the inside of the core portion 13. The fastener comprises a recess 17 as defined by two projecting walls 16, which recess 17 is preferred to have at its inner portions a sectional width broader than at its entrance, so that the stopper 18 may be snapped and fitted tightly therein.

The stopper 18 comprises a protuberant portion 20 and a flat portion 19, both connected with each other to form a T-shape in a sectional view thereof. The projection 20 has an enlarged end so as to be easily and tightly snapped into the recess of the fastener. It is preferable that a plurality of projections 20 be provided on the stopper 18, aligned in the longitudinal direction. Moreover the stopper 18 is provided with an end cover 21 to be set at the head of the hairbrush.

Figure 6:
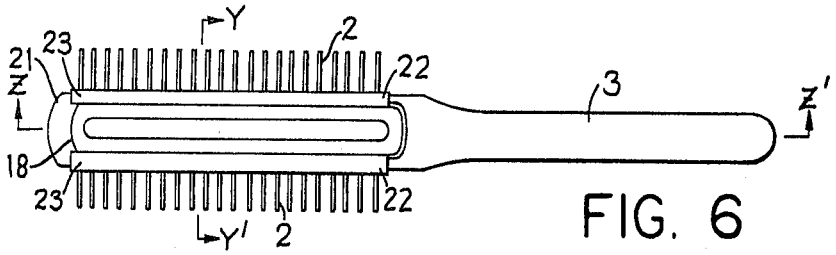
FIG. 6 is a plan view of an embodiment of the invention wherein the bristles are implanted in a flexible sheet.
Figure 7:
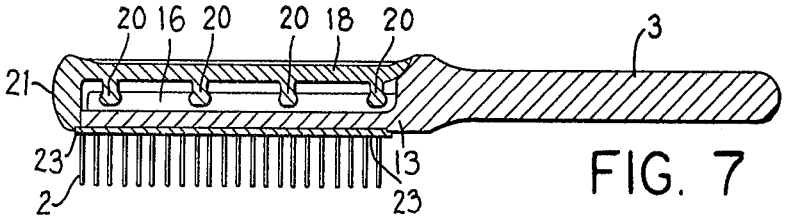
FIG. 7 is a longitudinal cross-sectional view taken along the line Z—Z' in FIG. 6.
Figure 8:
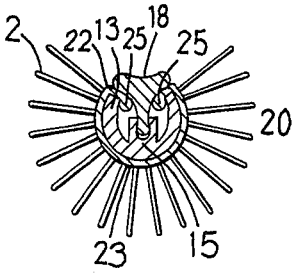
FIG. 8 is a cross section of the implanted portion taken along the line Y—Y' in FIG. 6.
Figure 9:
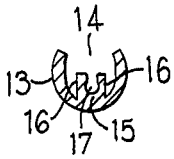
FIG. 9 is a cross section of the core portion 13.
Figure 10:
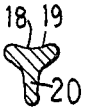
FIG. 10 is a cross section of the stopper 18.

The flexible sheet 23 has many bristles 2 implanted thereon. It is preferred that the bristles be independently implanted on the sheet. The sheet 23 has almost the same length as that of the core 13 and a width a little narrower than the circumferential length of the core 13. The sheet 23 is provided along both edges with edge portions 25 protruding from the surface opposite to the surface where the bristles 2 are implanted. FIGS. 6 to 8 indicate also how to assemble a hairbrush from the core 13, the sheet 23 and the stopper 18. The flexible sheet 23 is placed in contact with the core 13 on the surface thereof having no bristles 2 thereon and wound on the core 13. Then, both raised edges 15 of the sheet 23 are inserted into the opening 14 of the core 13 and further the stopper 18 is inserted therein so as to be engaged into the fastener 15, by sliding the stopper 18 from the top of the core 13 forward of the handle portion 3. The fastener 15 and the stopper 18 may be formed into various shapes and accordingly the assembly procedure may be changed.

A hairbrush according to the invention may be provided with a small indication means 26 comprising a projection, a recess or a combination thereof on the surface of the handle portion 3 at a position near to the bristle-implanted portion 1.

When a user uses the hairbrush according to the invention having the bristle implanted portion 1 and a defined area where no bristles 2 are implanted, the user will wish to know whether or not the bristle-implanted area is effectively contacting the hair.

For this purpose, the embodiment (III) provides the hairbrush on the handle portion with an indicative unevenness such that a user may touch it with, for example, the thumb and know the position of the bristle-implanted area even during use. The uneveness may comprise a convexity, a concavity or a combination of convexities and concavities in sequence, and is preferred to be located at such a position that it is easy to touch it with the thumb of the handling hand.

What is claimed is:

1. A hairbrush comprising an elongated, substantially straight, hairbrush body having a longitudinally extending handle and an elongated bristle-implanted portion extending longitudinally from one longitudinal end of said handle, said bristle-implanted portion comprising an elongated central core having an arcuate peripheral surface portion and a relatively thin sheet wrapped around and secured to said arcuate peripheral surface portion of said core and conforming to the curvature thereof, said handle and said bristle-implanted portion being longitudinally aligned with each other, said hairbrush body having a longitudinal central axis which extends through the central portions of said handle and said core, the outer surface of said sheet being spaced a uniform distance from the longitudinal central axis of said hairbrush body, a multitude of bristles affixed to said sheet and projecting from the outer surface thereof in a radially outward direction with respect to the longitudinal central axis of said hairbrush body, each of said bristles consisting of a single strand of bristle material, said single strands of bristle material being independent and discrete from one another and being spaced-apart from each other longitudinally and laterally on said outer surface of said sheet, all of said single strands of bristle material lying within and being distributed throughout a single continuous region wherein imaginary radial lines drawn from the longitudinal central axis of said hairbrush body through the respective opposite longitudinal edges of said region define a reflex angle of from 210° to 270°, the remainder of said bristle-implanted portion being free of bristles.

2. A hairbrush as claimed in claim 1, wherein said bristle-implanted portion is of substantially cylindrical shape.

3. A hairbrush comprising an elongated hairbrush body having a handle and an elongated bristle-implanted portion extending longitudinally from one end of said handle, said bristle-implanted portion comprising an elongated, hollow, partially cylindrical, core having an arcuate outer surface and defining a longitudinally extending opening between the opposite peripheral ends of said core, a bristle-implanted sheet wrapped around said arcuate outer surface of said core and conforming to the curvature thereof, said sheet having projections on opposite edges thereof which projections extend through said longitudinally extending opening into said core, a stopper inserted into said longitudinally extending opening means for closing said opening and securing said projections therein thereby fastening said sheet to said core, said bristle-implanted sheet having a peripheral surface and a multitude of bristles projecting from said peripheral surface in a radially outward direction with respect to the longitudinal central axis of said bristle-implanted portion, each of said bristles consisting of a single strand of bristle material, said single strands of bristle material being independent and discrete from one another and being spaced-apart from each other longitudinally and laterally on said peripheral surface of said bristle-implanted sheet, all of said single strands of bristle material lying within and being distributed throughout a single continuous region wherein imaginary radial lines drawn from the longitudinal central axis of said bristle-implanted portion through the respective opposite longitudinal edges of said region define a reflex angle of from 210° to 270°, the remainder of said bristle-implanted portion being free of bristles.

4. A hairbrush as claimed in claim 1 or claim 2, wherein said handle portion includes indicator means thereon adapted to permit a user of said hairbrush to determine by touch the orientation of said region of said bristle-implanted portion on which said bristles are distributed.

5. A hairbrush as claimed in claim 1 or claim 2, wherein said bristles are from 0.5 to 2 mm in cross-sectional size and project a distance of from 10 to 25 mm from said outer surface of said sheet, the implantation density of said bristles on said outer surface of said sheet being 9 to 25 bristles per $cm^2$.

6. A hairbrush as claimed in claim 1 or claim 2 in which said inner ends of said bristles are disposed inwardly of the outer surface of said sheet.

7. A hairbrush comprising an elongated hairbrush body having a handle and an elongated bristle-implanted portion extending longitudinally from one end of said handle, said bristle-implanted portion having a peripheral surface and a multitude of bristles projecting from said peripheral surface in a radially outward direction with respect to the longitudinal central axis of said bristle-implanted portion, each of said bristles consisting of a single strand of bristle material, said single strands of bristle material being independent and discrete from one another and being spaced-apart from each other longitudinally and laterally on said peripheral surface of said bristle-implanted portion, all of said single strands of bristle material lying within and being distributed throughout a single continuous region constituting a major fraction of said peripheral surface of said bristle-implanted portion wherein imaginary radial lines drawn from the longitudinal central axis of said bristle-implanted portion through the respective opposite longitudinal edges of said region define a reflex angle of from 210° to 270°, the remainder of said peripheral surface of said bristle-implanted portion being free of bristles, the bristles located adjacent to the longitudinal edges of said region of said peripheral surface of said bristle-implanted portion being the shortest of said bristles, the lengths of the remainder of said bristles progressively increasing in a direction toward the longitudinal centerline of said region.

8. A hairbrush as claimed in claim 3, wherein said core has a single, longitudinally extending opening therein extending the entire length of said core, and said stopper comprises a longitudinally extending rod set into said single opening, thereby wedging said projections against the edges of said core defining said single opening, said rod having one or more protuberances having enlarged ends extending through said single opening towards the inner surface of said core opposite said opening, said inner surface being provided with a pair of upright, flexible, approximately parallel walls defining a cavity having an enlarged inner end, said walls being adapted to flexibly receive said protuberances therebetween, said enlarged ends of said protuberances mating with said enlarged end of said cavity, thereby securing said rod to said core.

9. A hairbrush as claimed in claim 7 in which the longest bristles have a length of 10 to 25 mm, the shortest bristles have a length of 3 to 20 mm and the ratio of the lengths of the longest bristles to the shortest bristles is from 1:0.3 to 1:0.8, said bristles having a cross-sectional size of from 0.5 to 2 mm and the implantation density of said bristles on said peripheral surface of said bristle-implanted portion is from 9 to 25 bristles per $cm^2$.

* * * * *